US006312482B1

(12) United States Patent
James et al.

(10) Patent No.: US 6,312,482 B1
(45) **Date of Patent: *Nov. 6, 2001**

(54) STEAM GENERATOR FOR GASIFYING COAL

(75) Inventors: David E. James, Barberton; Paul S. Larsen, Massillon; Mark C. Godden, Coventry Township, Summit County; Ted V. Mull, Jr., Copley Township, Summit County; Paul S. Weitzel, Canal Fulton, all of OH (US)

(73) Assignee: The Babcock & Wilcox Company, New Orleans, LA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/114,743

(22) Filed: Jul. 13, 1998

(51) Int. Cl.[7] ..... C10J 3/20; C10J 3/66

(52) U.S. Cl. ..... 48/73; 48/77; 48/202

(58) Field of Search ..... 48/61, 62 R, 73, 48/74, 77, 80, 85, 210, 202; 110/260, 308, 344

(56) References Cited

U.S. PATENT DOCUMENTS

| | | | | |
|---|---|---|---|---|
| 4,270,493 | * | 6/1981 | Blaskowski | 122/7 R |
| 4,328,007 | * | 5/1982 | Rafael | 48/73 |
| 4,487,612 | * | 12/1984 | Hebden et al. | 48/77 |
| 5,309,848 | * | 5/1994 | Santelmann et al. | 110/171 |
| 5,390,631 | * | 2/1995 | Albrecht | 122/235.12 |
| 5,425,791 | * | 6/1995 | Tanca | 48/76 |

OTHER PUBLICATIONS

Davey et al., An Advanced Coal Gasification Process and its Influence on the Manufacture of Ammonia, Methanol and CO Chemicals, presented at the ASIA Nitrogen '98 International Conference and Exhibition in Kuala Lumpur, Malaysia, Feb. 22–24, 1998, pp. 165–185.

* cited by examiner

*Primary Examiner*—Shrive Beck
*Assistant Examiner*—Alexa A. Doroshenk
(74) *Attorney, Agent, or Firm*—Robert J. Edwards; Daniel S. Kalka; Eric Marich

(57) ABSTRACT

A combined, integral steam generator coal gasifier includes a vertically elongated, all welded, gas tight enclosure with a burner zone having a double pitch sloping furnace floor and a slag tap extending therethrough. Successive zones located above the burner zone are provided with appropriate tube materials for conveying synthesis gas produced by the coal gasification process. A multi-pass convection pass zone having upflow and downflow passes is located at an upper portion of the enclosure and contains a plurality of superheater (primary and secondary) as well as economizer heating surfaces which extract heat from the synthesis gas to produce steam. An ash remover is connected to the outlet of the convection pass zone to remove ash from the synthesis gas exiting from the convection pass zone. The slag tap located at the bottom of the burner zone communicates with a slag tank or a drag chain deasher for receiving and removing slag from the burner zone.

21 Claims, 13 Drawing Sheets

STEAM GENERATOR FOR GASIFYING COAL

FIELD AND BACKGROUND OF THE INVENTION

1. Field of the Invention

The present invention relates in general to coal gasifiers and, in particular, to a new and useful combined, integral steam generator coal gasifier for converting coal into useable gas products while at the same time producing steam for electric power generation and/or process requirements.

2. Description of the Related Art

FIGS. 1–6 illustrate various known coal gasifier constructions with a wide variety of configurations, system parts and relationships.

In 1951, The Babcock & Wilcox Company (B&W) supplied an atmospheric-pressure, oxygen and steam-blown, slagging-type, entrained-flow gasifier to the U.S. Bureau of Mines at Morgantown, W. Va. FIG. 1A illustrates this device. In addition, B&W also supplied to the U.S. Bureau of Mines at Morgantown, W. Va., a pressurized oxygen-and steam-blown, slagging type, entrained flow gasifier; see FIG. 1B. In the early 1950's B&W was involved in the supply of a semicommercial-size, atmospheric-pressure, oxygen-and steam-blown, slagging type, entrained flow gasifier to E. I. DuPont de Nemours (DuPont) at Belle, W. Va. which is shown in FIG. 2, followed by a commercial-size gasifier at the same location; see FIG. 3. In the middle 1950's, B&W performed engineering studies and experimental work on air-blown, slagging-type, entrained-flow gasification for combined gas turbine-steam turbine cycles. This resulted in a joint project with General Electric Company where a gasifier was operated (over a 3 year period in the 1960's) at B&W's Alliance Research Center; please refer to FIG. 4. In 1976, B&W constructed a gasifier for the Bi-Gas pilot plant at Homer City, Pa., which was sponsored by the U.S. Department of Energy; see FIG. 5. B&W was also involved in a joint venture with Koppers Company, Inc. in the 1980's, known as KBW Gasification Systems, Inc. The KBW gasifier and auxiliary equipment are shown in FIG. 6. Out of that grew the technology and design which is the basis for the present invention.

SUMMARY OF THE INVENTION

The present invention is drawn to a new combined, integral steam generator coal gasifier for converting coal into useable gas products, particularly synthesis gas, while at the same time producing steam for electric power generation and/or process requirements. The integral steam generator coal gasifier has unexpected and useful advantages over any of the previous designs.

Accordingly, one aspect of the present invention is drawn to an integral steam generator coal gasifier for simultaneously producing synthesis gas from coal, and steam from heat produced by a coal gasification process. The integral steam generator coal gasifier comprises a vertically elongated, all welded, gas tight enclosure having walls made from a plurality of membrane wall tube panels. The coal gasification process occurs within the enclosure and produces hot synthesis gas, and heat which is transferred to a mixture of water and steam flowing through the tube panels. The enclosure conveys the hot synthesis gas from a burner zone at a lower portion thereof to an outlet. A double pitch sloping furnace floor is provided at a bottom of the burner zone and having a slag tap extending therethrough to remove slag produced during the coal gasification process. A corrosion resistant zone is provided above the burner zone, while an upper cooling zone is provided above the corrosion resistant zone.

Advantageously, the enclosure walls of the corrosion resistant zone comprise one of bimetallic and/or composite membrane tube panels, while the enclosure walls of the upper cooling zone can merely comprise carbon steel membrane tube panels. A multi-pass convection pass zone is provided above the upper cooling zone, and the multi-pass convection pass zone defines a region containing heating surfaces which extract heat from the synthesis gas as it flows across the heating surfaces. Preferably, the convection pass zone comprises an upflow pass and a downflow pass for conveying the synthesis gas from the upper cooling zone to the outlet. The heating surfaces within the convection pass zone comprise superheater and economizer surfaces for extracting heat from the synthesis gas. The superheater surfaces comprise secondary and primary superheater surface in the upflow pass and economizer surface in the downflow pass. Part of the primary superheater may be located in both the upflow pass and the downflow pass; particularly, inlet bank(s) of the primary superheater may be located at the top of the downflow pass, while outlet bank(s) of the primary superheater may be located at the top of the upflow pass. Finally, ash removal means are provided, connected to an outlet of the convection pass zone for separating ash from the synthesis gas exiting from the convection pass zone, while slag removal means communicate with the slag tap for receiving slag from the burner zone.

Another aspect of the invention involves a construction wherein the sloped furnace floor and the walls of the burner zone are comprised of ribbed tubes having a pattern of pin studs thereon covered by a refractory material. Advantageously, the ribbed tubes are multi-lead ribbed tubes.

Various proven technologies are also used to improve the predictability and modeling of the coal gasifier and, in particular with regard to its burner flame, the furnace temperature, and the gasification reactions. In particular, these modeling techniques particularly influenced the burner and burner zone design configuration.

Thus, yet another aspect of the present invention involves the arrangement and orientation(s) of the burners with respect to the walls through which they fire (i.e., their associated wall). Generally, at least one elevation (preferably two) of offset burners is provided in the burner zone, burners provided and arranged so as to fire through each of the four (4) walls of the enclosure. The term offset means that a burner on one wall is not located directly opposite a burner on an opposite wall. Each of the offset burners are arranged to fire through their associated wall of the enclosure at an angle $\theta$ with respect to a line perpendicular to the associated wall, angle $\theta$ lying within a range of about 0 degrees to about 25 degrees. Preferably, however, angle $\theta$ has a non-zero value lying within a range of about 15 degrees to about 25 degrees.

In addition, not only is there provided at least one elevation of offset burners in the burner zone, one burner being provided and arranged so as to fire through each wall of the enclosure, but each one burner is also located on its associated wall a distance away from a corner of the enclosure lying within a range of about one-fifth to about one-third of the width of the associated wall. Together with an appropriate value for angle $\theta$, a vortex is produced within the enclosure which enhances the coal gasification process.

Another aspect of the present invention involves the double pitch sloping furnace floor, and which preferably comprises a plurality of K-forgings which physically interconnect tubes forming the sloping furnace floor and fluidically interconnect them with headers located beneath the sloping furnace floor. Generally, each K-forging physically joins two tubes from opposite front and rear walls of the enclosure to form the double pitch sloping furnace floor.

The various features of novelty which characterize the invention are pointed out with particularity in the claims annexed to, and forming a part of, this disclosure. For a better understanding of the invention, its operating advantages and specific benefits attained by its uses, reference is made to the accompanying drawings and descriptive matter in which preferred embodiments of the invention are illustrated.

BRIEF DESCRIPTION OF THE DRAWINGS

In the drawings:

FIG. 7(*a*) is a cross sectional view of the back wall of the FIG. 7 steam generator coal gasifier comprising ribbed tubing which is turned inward along a section thereof to form a dividing wall in the multi-pass convection zone separating the upflow pass and downflow pass sections of the convection zone.

DESCRIPTION OF THE PREFERRED EMBODIMENTS

Figure 7:
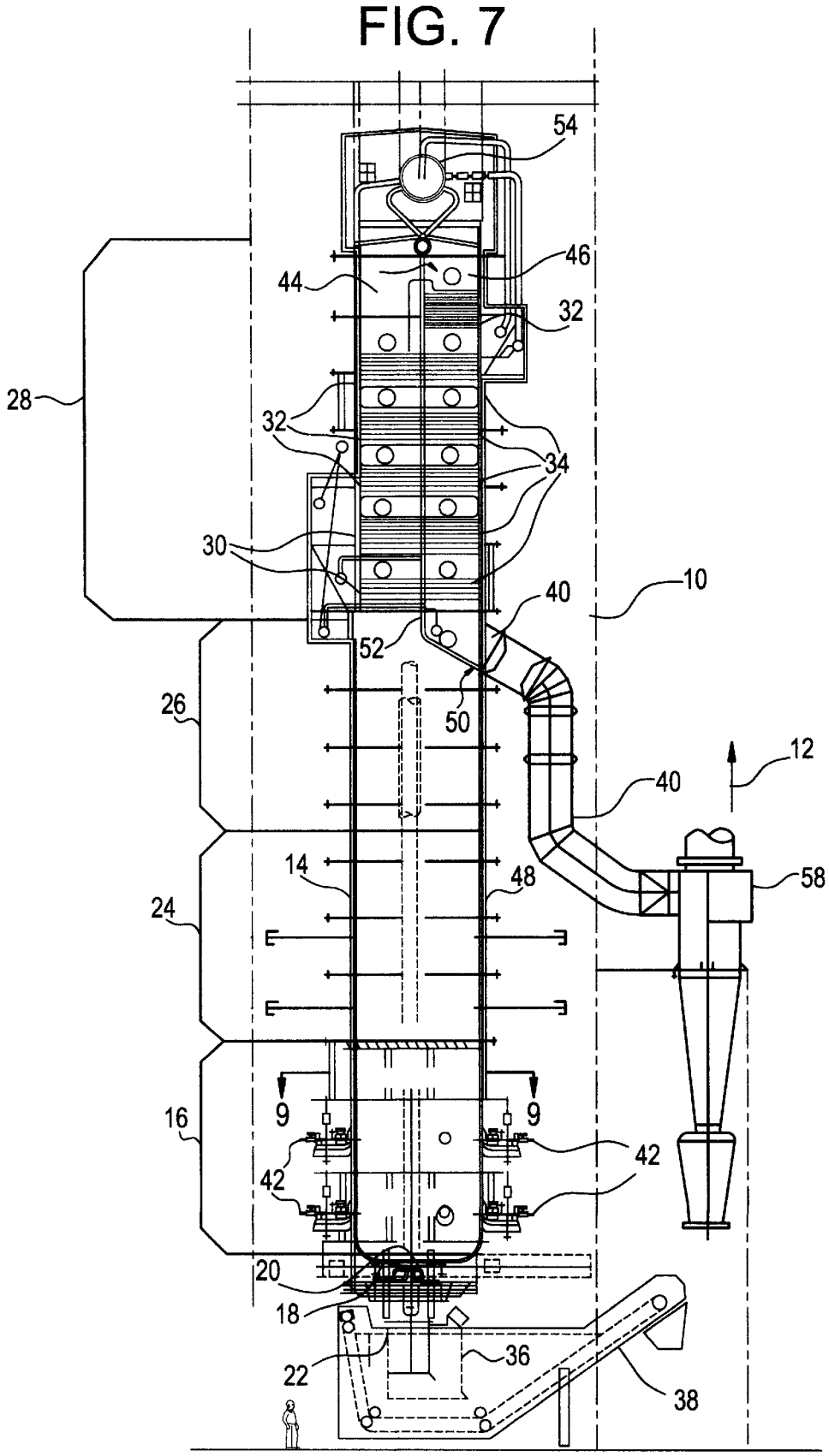
FIG. 7 is a vertical sectional view of a combined, integral steam generator coal gasifier arrangement according to the present invention.
Figure 7A:
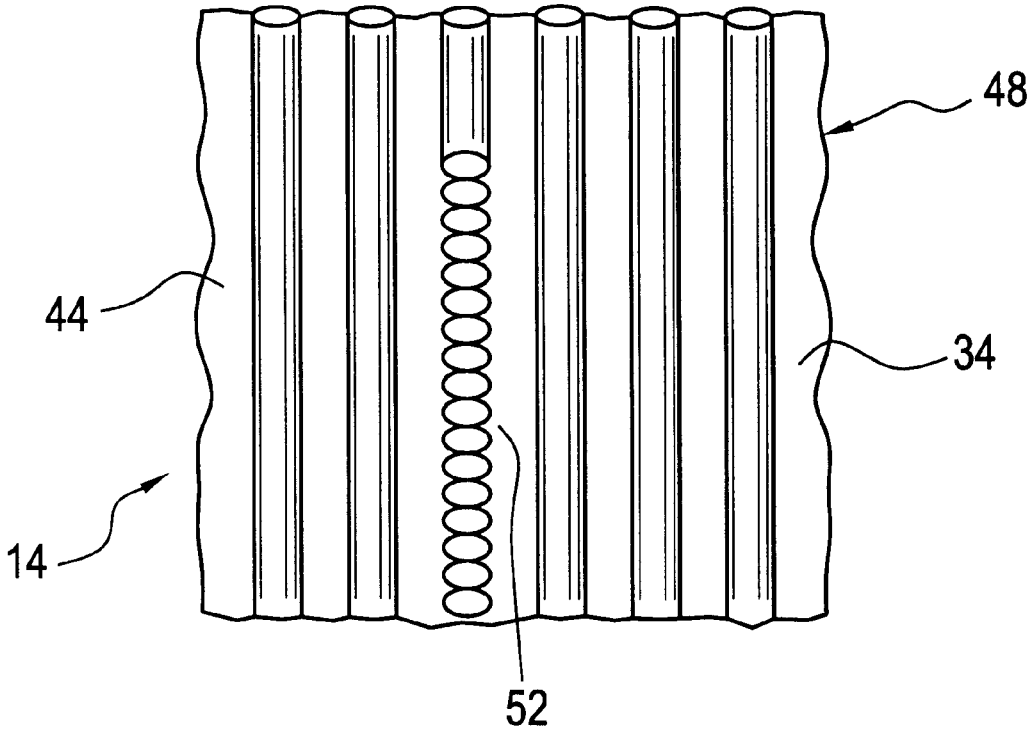
Figure 8:
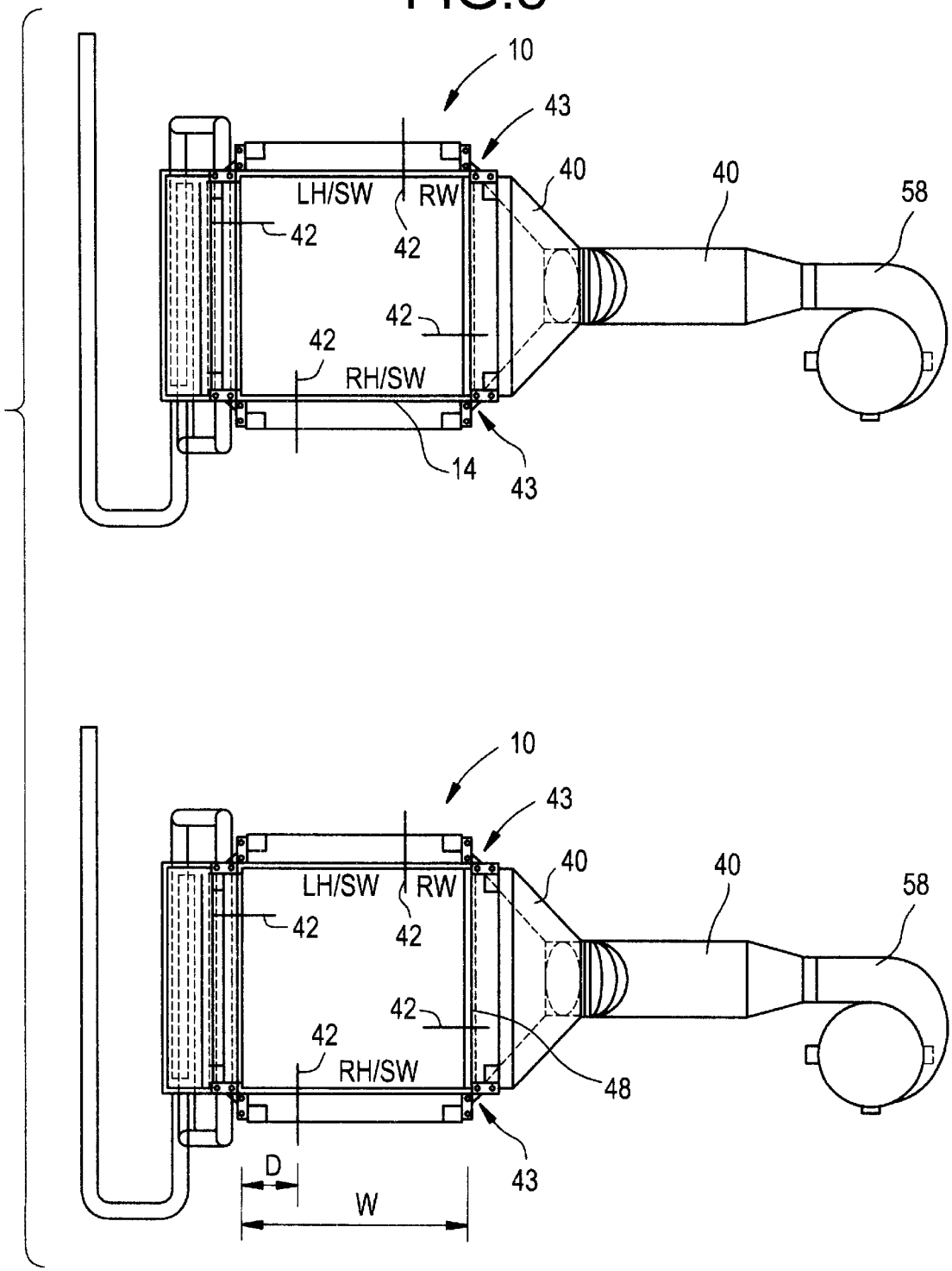
FIG. 8 is a top plan view of a plural steam generator coal gasifier arrangement of the type shown in FIG. 7, illustrating one possible installation wherein two such steam generator coal gasifiers could be employed side-by-side.

Referring to the drawings generally, wherein like reference numerals designate the same or functionally similar elements throughout the several drawings, and to FIGS. 7 and 8 in particular, there is shown an integral steam generator coal gasifier, generally designated 10, according to the present invention. The steam generator coal gasifier 10 employs various elements from the prior art, but represents a new advantageous combination and arrangement that has unexpected advantages over any of the previous structures alone or in combination.

As illustrated in FIG. 7, the steam generator coal gasifier 10 is an atmospheric-pressure, oxygen- (or oxygen-containing gas or fluid such as steam, air, oxygen-enriched air, carbon dioxide, or the like) blown gasifier designed for the production of raw synthetic gas 12. This synthetic gas 12 may be further refined and made into ammonia or the like, for example, or for the production of fertilizers, methanol, CO, chemicals and explosives, etc., for industry. While FIG. 7 only illustrates a single steam generator coal gasifier 10 arrangement, it will be readily appreciated by those skilled in the art that two or more steam generator coal gasifiers 10 could be employed at a given installation. This aspect is schematically shown in FIG. 8, which illustrates two (2) steam generator coal gasifiers 10 side-by-side. The design of the integral steam generator coal gasifier 10 incorporates a variety of proven technologies in an unobvious combination with each other to meet design objectives.

In accordance with the present invention, the integral steam generator coal gasifier 10, includes the following features:

- An all welded gas tight enclosure 14 construction;
- A dense-spaced pin stud pattern with an overlying layer of refractory in a burner zone 16 and on a double pitch sloping furnace floor 18, preferably employing K forgings and multi-lead ribbed tubes in the sloping furnace floor 18;
- A slag tap 20 in the sloping furnace floor 18, including a slag neck 22;
- Use of bimetallic/composite membraned tubes in a corrosion resistant zone 24 above the burner zone 16, with a transition to less expensive carbon steel tubes in an upper cooling zone 26 above the corrosion resistant zone 24;
- Use of a standard B&W drum boiler RB-El Paso™ furnace enclosure and multi-pass convection pass 28 design, with standard B&W RB-El Paso™ structural support and appropriate erosion protection, which locates standard secondary superheater (SSH) 30, primary superheater (PSH) 32, and economizer (EC) 34 heating surfaces within the same enclosure 14 "footprint", thereby reducing plant area requirements;
- Use of gasification reaction and furnace temperature predictions;

A furnace wall seal arrangement for sootblowers and convection surface penetrations suitable for gas tight, reliable operation;

Use of computer flow diagram (CFD) modeling to predict burner flame and particulate flow patterns, as well as to predict interaction of burner flames; and Use of proven slag tank 36 or drag chain conveyer 38 for bottom ash removal.

Advantages of the invention include utilizing components that have been proven through prior use, but not in the combination or configuration of the present invention, to provide a safe and reliable solution for industries requiring synthetic gas products. The invention also utilizes computer modeling for determining gasification reactions, CFD modeling for determining furnace flame patterns, burner design and placement, and furnace temperature profiles. The advancements in this technology have not been used for designing coal gasifiers in the past.

Figure 1A:
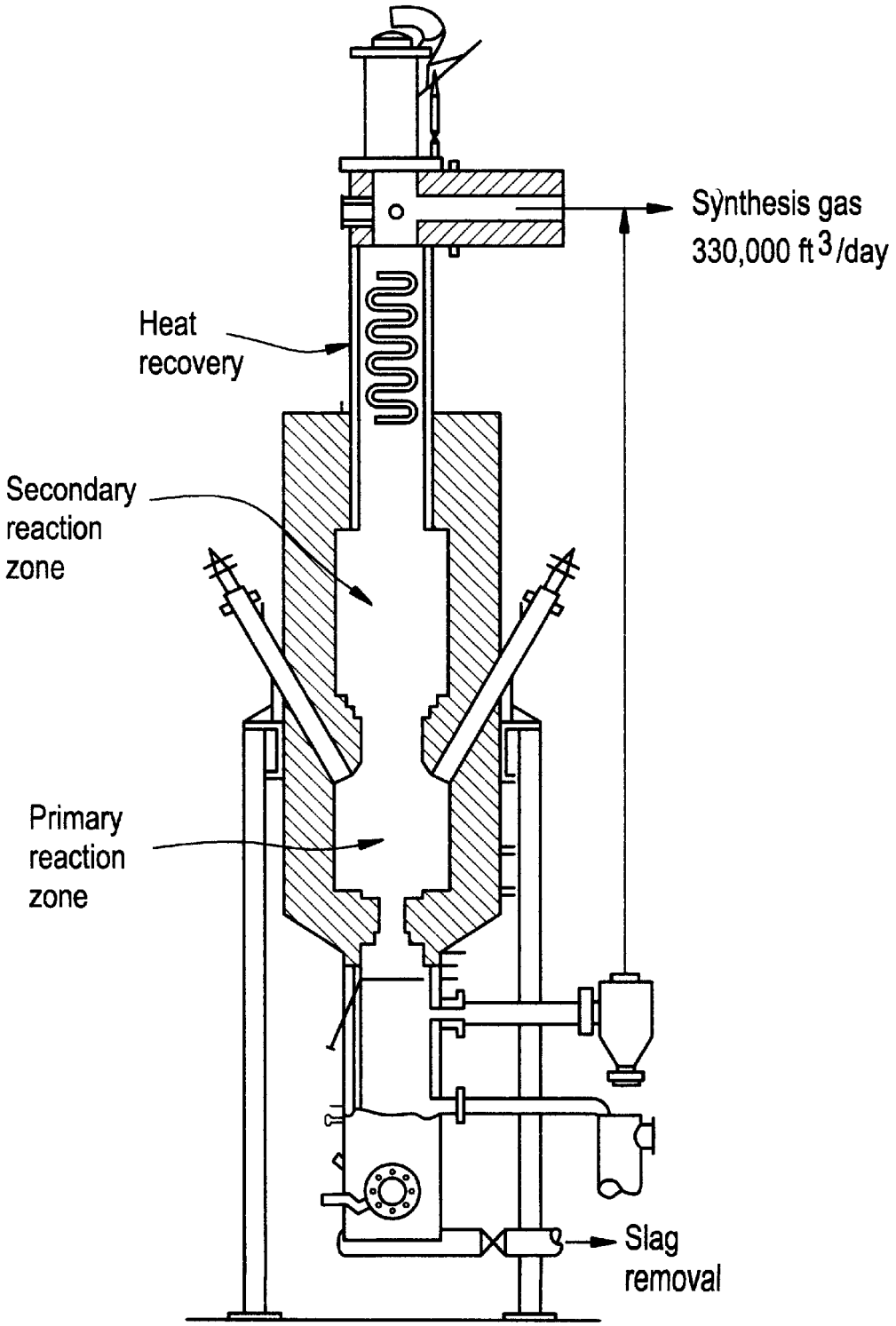
FIG.1A PRIOR ART
FIG. 1A is a side elevation view of a known atmospheric-pressure gasifier construction provided to the U.S. Bureau of Mines.
Figure 1B:
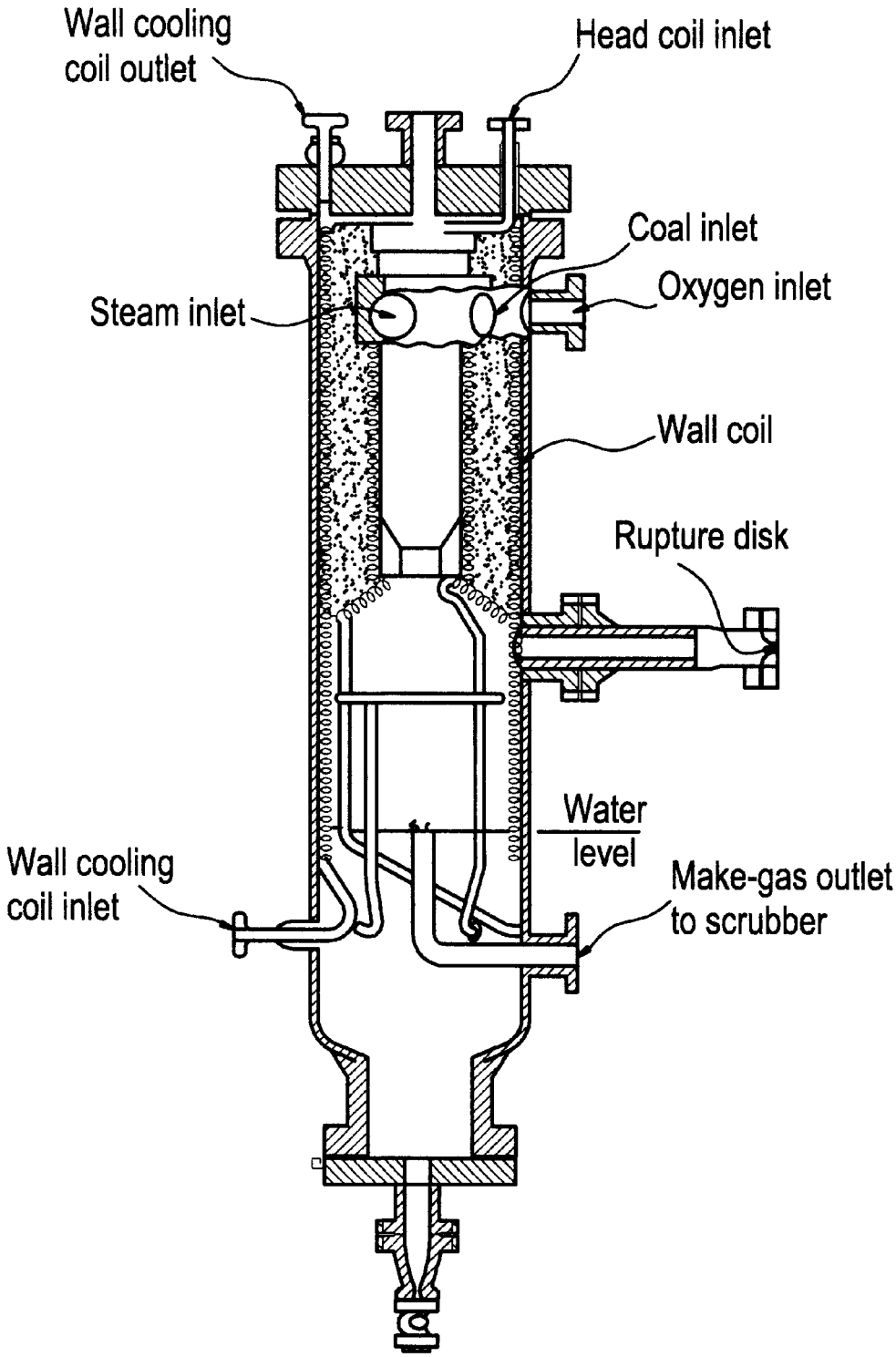
FIG. 1B PRIOR ART
FIG. 1B is a side elevation view of a known pressurized gasifier construction provided to the U.S. Bureau of Mines.
Figure 2:
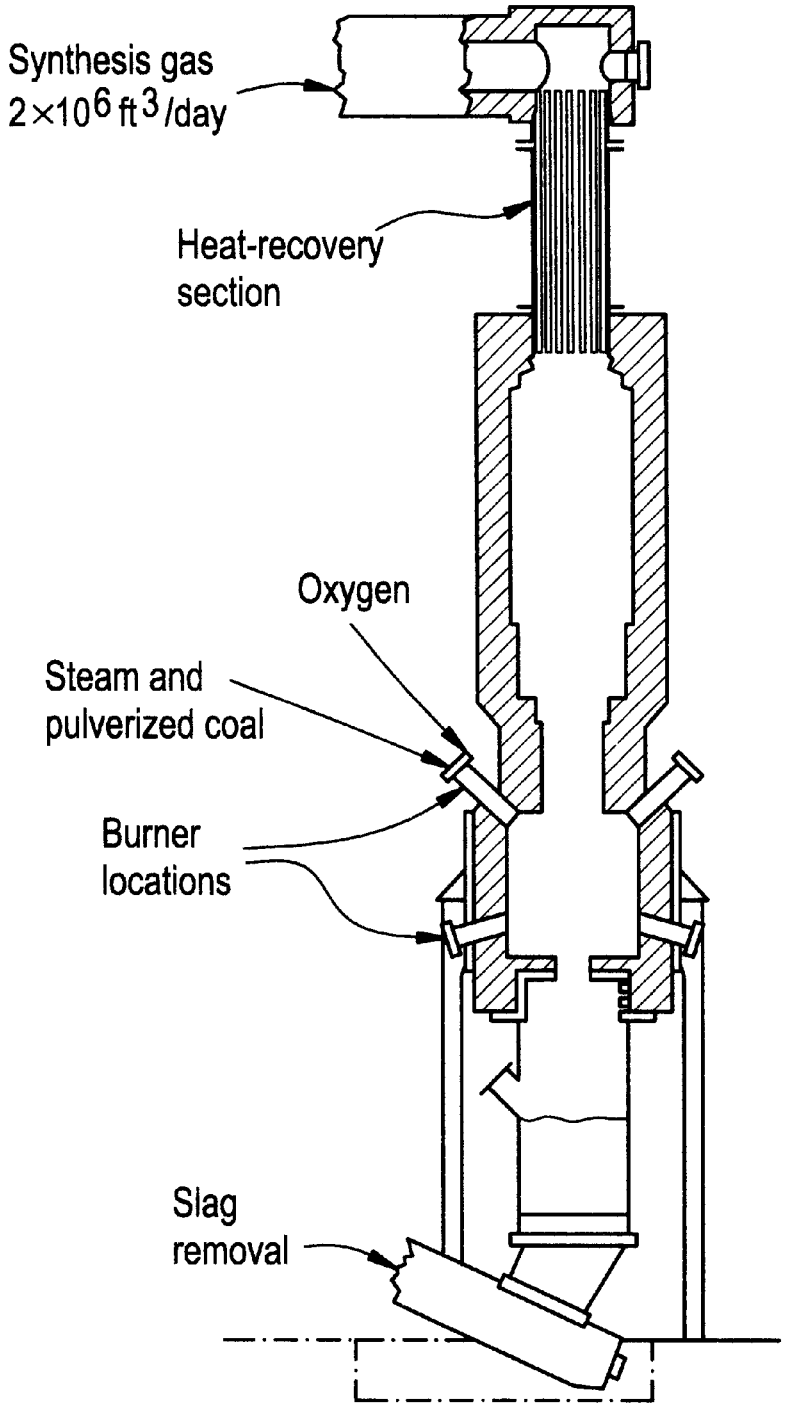
FIG.2 PRIOR ART
FIG. 2 is a view similar to FIGS. 1A and 1B of a known semicommercial size, atmospheric pressure, gasifier construction provided to DuPont.
Figure 3:
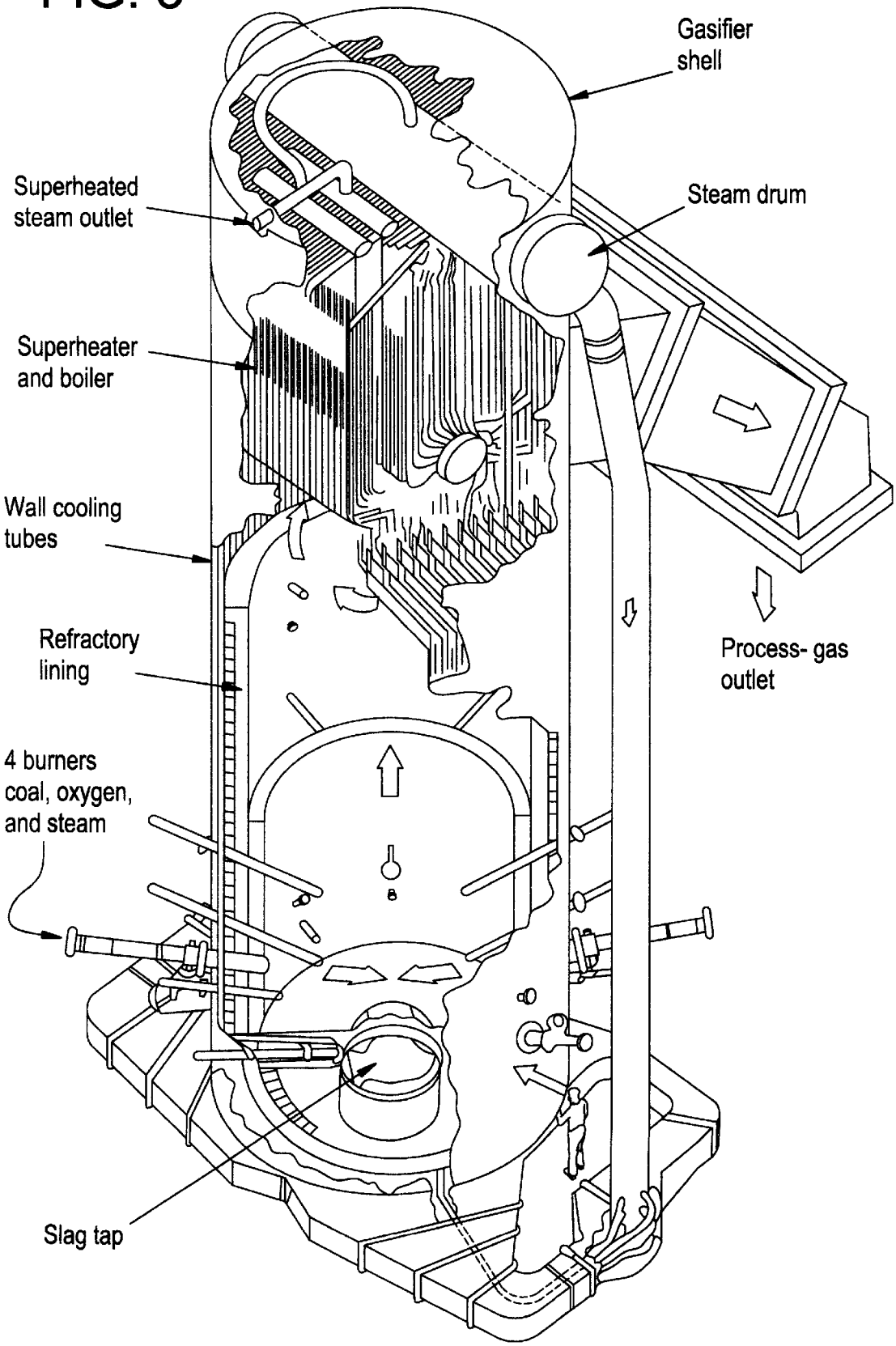
FIG. 3 is a perspective view, with portions cut away, of a known commercial-size, atmospheric pressure, gasifier construction provided to DuPont.
Figure 4:
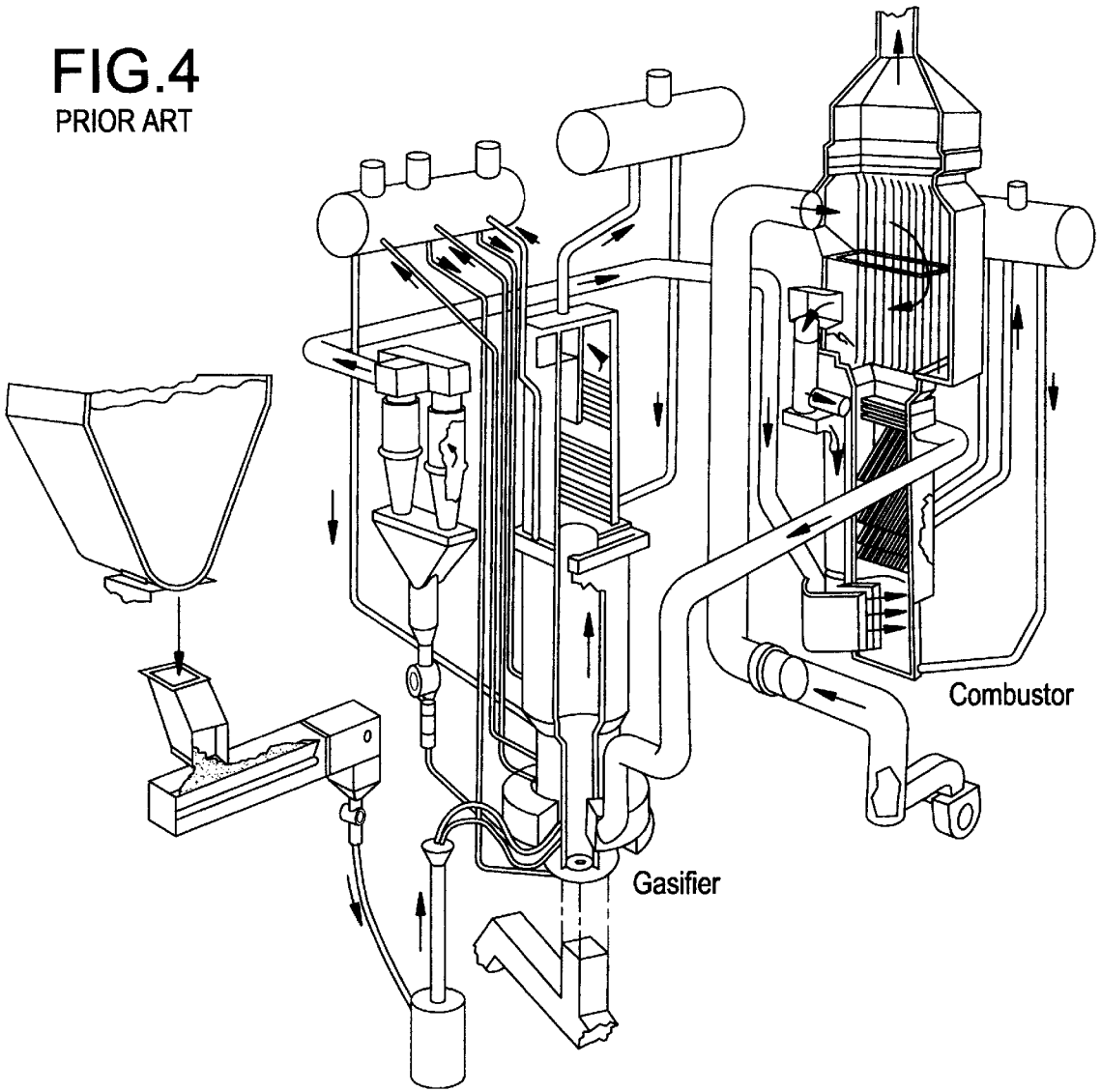
FIG.4 PRIOR ART
FIG. 4 is a perspective view of another gasifier construction, with portions cut away, used to perform engineering studies and experimental work involving combined gas turbine-steam turbine cycles for General Electric Company.
Figure 5:
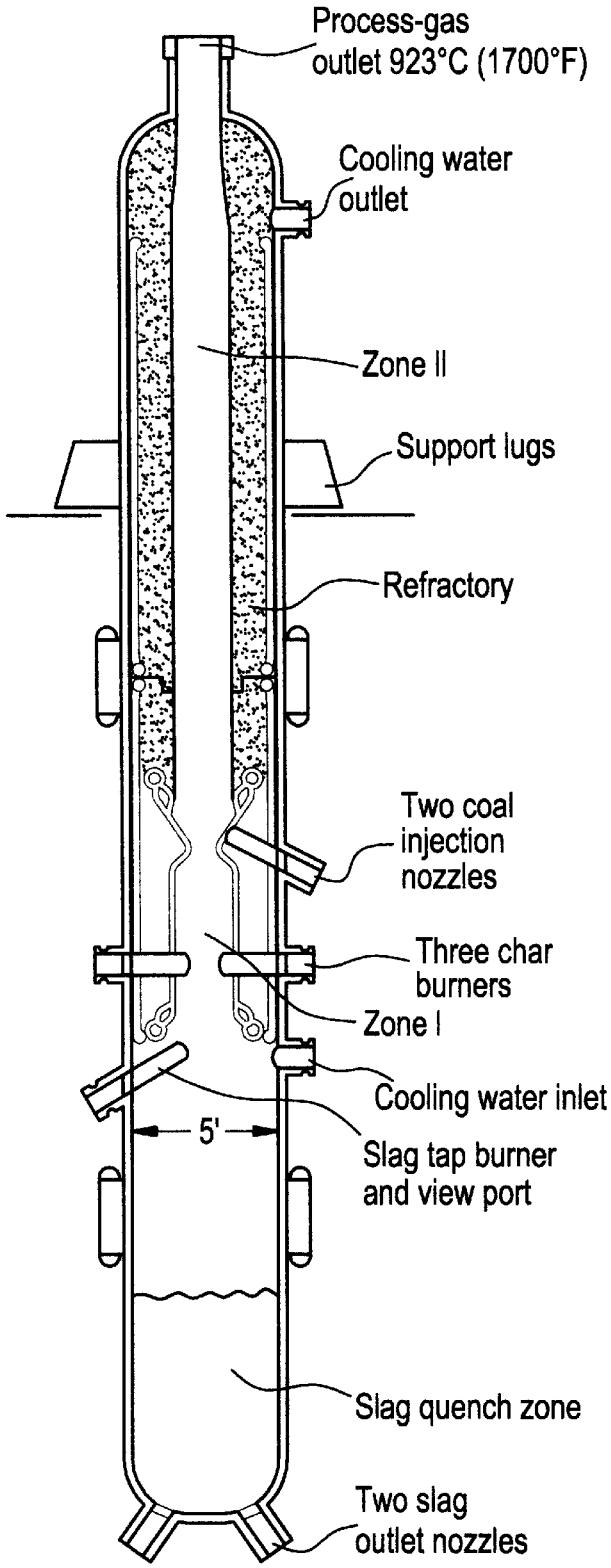
FIG. 5 PRIOR ART
FIG. 5 is a vertical sectional view of a known gasifier construction developed for a Bi-Gas pilot plant at Homer City, Pa. for the U.S. Department of Energy.
Figure 6:
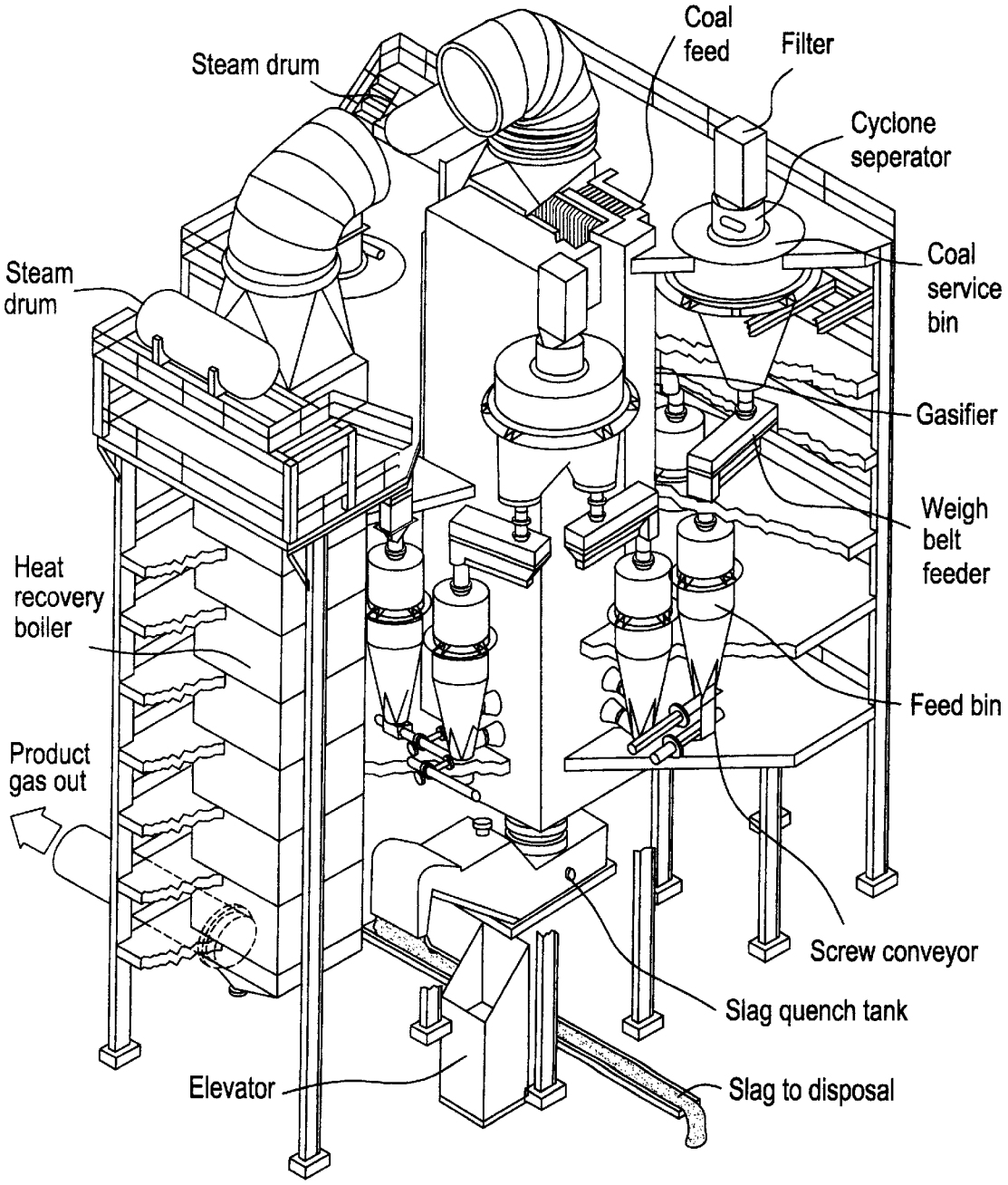
FIG.6 PRIOR ART
FIG. 6 is a perspective view of a known, more elaborate gasifier construction with a crossover flue between the separate gasifier and heat recovery sections.

The present invention provides a completely water-cooled, gas tight, enclosure 14 from the burner zone 16 to an outlet 40 of the multi-pass convection pass zone 28. This construction eliminates the need for a crossover flue as required in previous gasifier designs (see, for example, FIG. 6) and thus simplifies mechanical and maintenance issues while creating a reliable, compact, design.

The present invention also produces higher operating steam temperatures and pressures due to the use of pin studs/refractory, bimetallic and/or composite tubes, and proper selection of convection surface materials, resulting in higher steam cycle efficiencies.

As shown in FIGS. 7 and 8, the vertically elongated, all welded, gas tight enclosure 14 has four (4) walls made from a plurality of tubes formed into a plurality membrane wall tube panels of known construction. From bottom to top, the enclosure 14 comprises several zones: a burner zone 16, a corrosion resistant zone 24, an upper cooling zone 26, and a multi-pass convection pass zone 28. The coal gasification process which produces the synthesis gas 12 takes place within the enclosure 14, and primarily occurs in the burner zone 16, and corrosion resistant zone 24, and upper cooling zone 26, and produces heat which is conveyed into a mixture of water and steam flowing through the membrane wall tube panels forming the enclosure 14. The enclosure conveys the synthesis gas 12 to an outlet 40 of the multi-pass convection pass zone 28. A double pitch sloping furnace floor 18 is provided at a bottom of the burner zone 16 and has a slag tap 20 extending therethrough which is connected to a slag neck 22. Slag neck 22 communicates the slag tap 20 with either a slag tank 36 or, preferably, a drag chain conveyor 38.

The sloping furnace floor 18 and the walls of the burner zone are preferably covered with a dense pattern of pin studs which are, in turn, covered by a layer of refractory material to protect the tubes from the corrosive environment therein. The pin stud pattern is such that the pin studs extend through the refractory for heat conduction. Additionally, the sloping furnace floor 18 and the walls of the burner zone 16 are preferably made of multi-lead ribbed tubes to enhance heat transfer characteristics and prevent the heat flux on these tubes from causing them to overheat and possibly fail.

Figure 9:
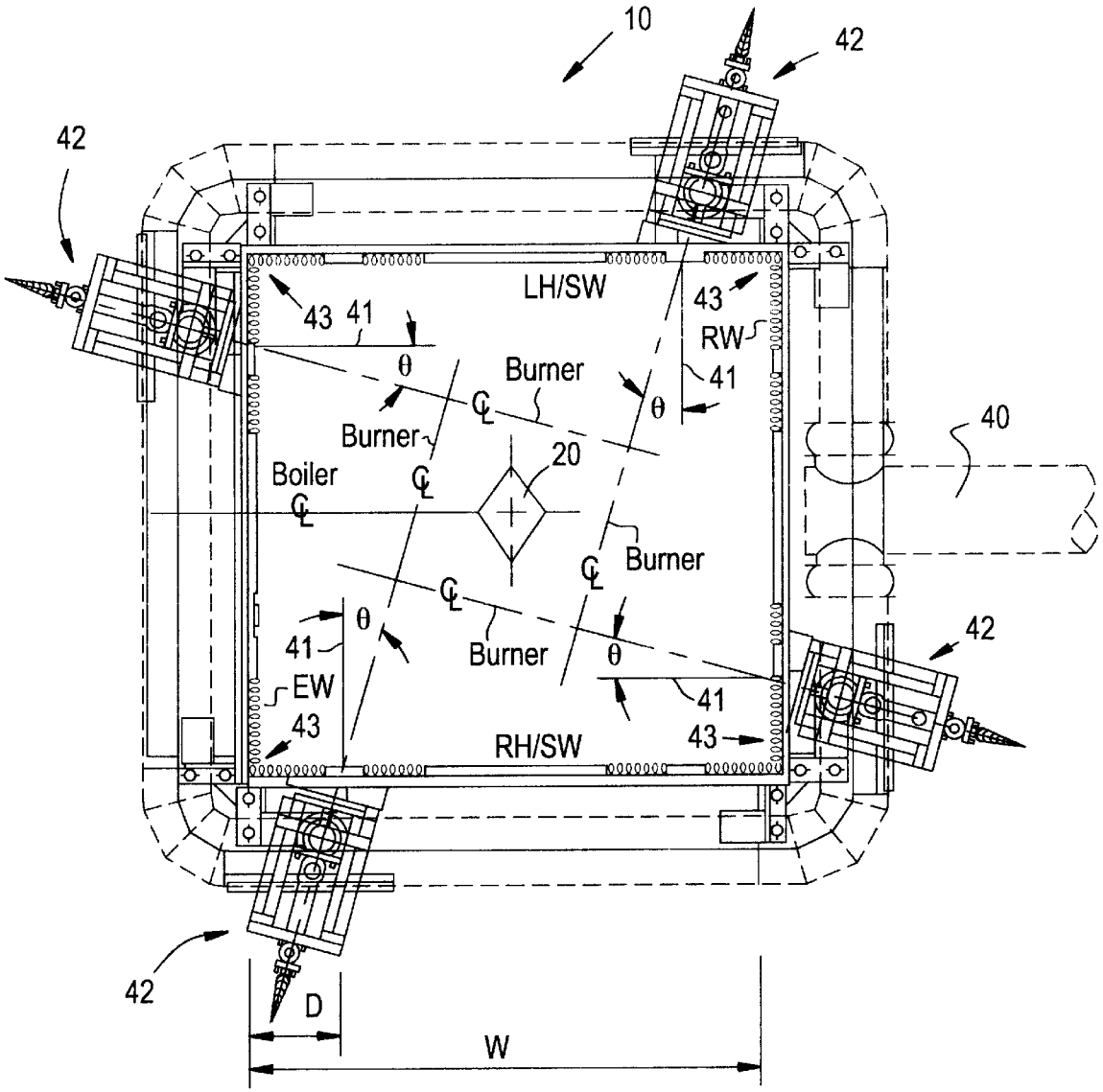
FIG. 9 is a sectional view of FIG. 7 taken in the direction of arrows 9—9 illustrating an alternative embodiment of the steam generator coal gasifier wherein the burners are positioned at an angle with respect to the walls of the enclosure through which they fire (i.e., their associated wall)

Referring to FIGS. 7–9, at least one elevation (preferably two) of offset burners 42 is provided in the burner zone 16, one burner 42 being provided and arranged so as to fire through each of the four (4) walls of the enclosure 14. The term offset means that a burner 42 on one wall is not located directly opposite a burner 42 on an opposite wall. Each of the offset burners 42 are arranged to fire through their associated wall of the enclosure 14 at an angle θ with respect to a line 41 perpendicular to the associated wall, angle θ lying within a range of about 0 degrees to about 25 degrees, and preferably having a non-zero value lying within a range of about 15 degrees to about 25 degrees.

Each burner 42 is also located on its associated wall a distance D away from a corner 43 of the enclosure 14 lying within a range of about one-fifth to about one-third of the width W of the associated wall. Together with an appropriate value for angle θ, a vortex is produced within the enclosure 14 which enhances the coal gasification process used to produce the synthesis gas 12.

Above the burner zone 16 are, in order of synthesis gas flow 12 from the burner zone 16 to the outlet 40, are: a corrosion resistant zone 24, advantageously having enclosure walls made of bimetallic and/or composite tubes; an upper cooling zone 26 which can employ carbon steel tubes; and a multi-pass convection pass zone 28 which defines a region containing heating surfaces which extract heat from the synthesis gas 12 as it flows across the heating surfaces. The multi-pass convection pass zone 28 comprises an upflow pass 44 and a downflow pass 46 for conveying the synthesis gas 12 from the upper cooling zone 26 to the outlet 40. The heating surfaces within the convection pass zone 28 comprise superheater (secondary superheater (SSH) 30, and primary superheater (PSH) 32) and economizer (EC) 34 surfaces for extracting heat from the synthesis gas 12. The SSH 30 and PSH 32 surface is located in the upflow pass 44, while the EC 34 surface is located in the downflow pass 46. Part of the PSH 32 may be located in both the upflow pass 44 and the downflow pass 46; particularly, inlet bank(s) of the PSH 32 may be located at the top of the downflow pass 46, while outlet bank(s) of the PSH 32 may be located at the top of the upflow pass 44.

The tubes of the rear wall 48 of the enclosure 14 are bifurcated part way up the wall 48, at 50, thereby forming the multiple upflow 44 and downflow 46 passes in the convection pass zone 28. This design feature is an aspect of B&W's El Paso™ type radiant boiler which eliminates the pendant convection pass and includes the upflow 44 and downflow 46 convection passes within the footprint occupied by the boiler furnace enclosure 14. Thus, some of the tubes forming the rear wall 48 bend inwardly out of the plane of the rear wall 48 and form a dividing wall 52 which separates the upflow pass 44 from the downflow pass 46. However, the synthesis gas 12 can pass from the upflow pass 44 into the downflow pass 46 because some of the tubes forming the wall 52 are further bent to create passages therebetween at the top of the enclosure 14. Similarly, as the synthesis gas 12 flows downwardly through the downflow pass 46, some of the tubes forming the rear wall 48 which continued straight up along the plane of the rear wall 48 are also bent to create passages so that the synthesis gas 12 can exit via outlet 40, in the vicinity of the bifurcation 50, again in a manner similar to that of a B&W El Paso™ type boiler construction.

All of the coils of the superheaters 30, 32 are arranged in such a way that they are drainable so as to prevent damage which could be sustained during startup of the steam generator coal gasifier 10. The PSH 32 is arranged in counter-flow with respect to the synthesis gas 12 flow so as to minimize the surface area required for the heat transfer duty. The SSH 30 is arranged partly in parallel flow with the synthesis gas 12 so as to minimize metal temperatures and the tendency for corrosion to occur.

Figure 10:
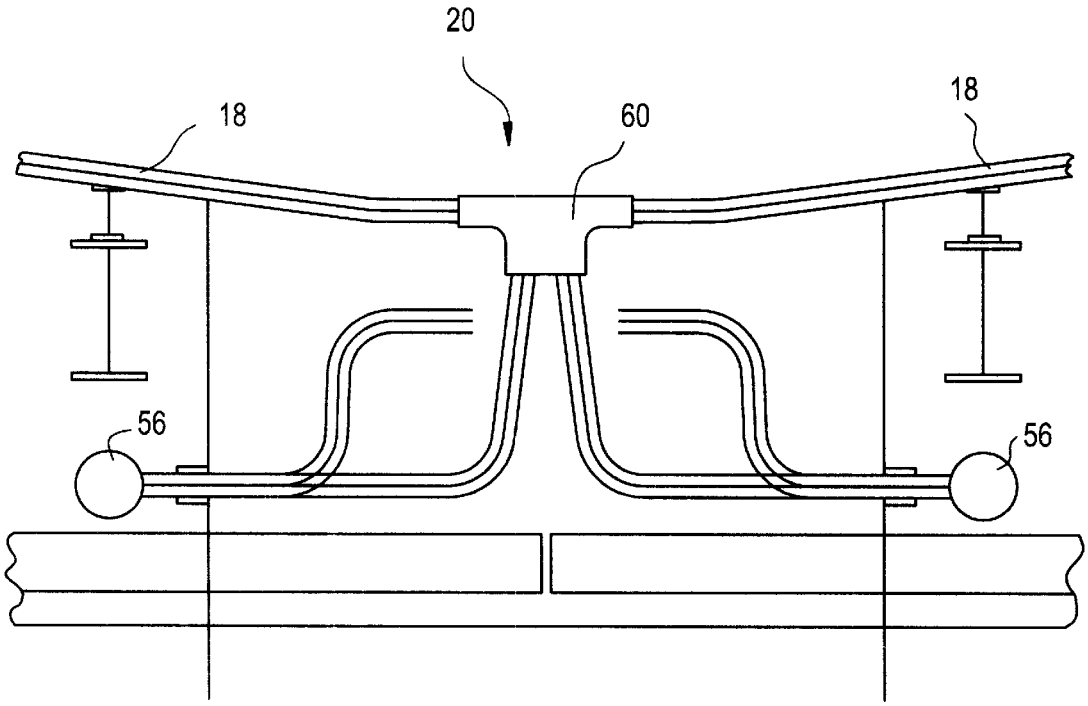
FIG. 10 is an enlarged sectional view of a lower portion of the steam generator coal gasifier of FIG. 7, illustrating a double pitch sloping furnace floor construction employing slag tap floor "K" forgings to physically and fluidically interconnect tubes forming the sloping furnace floor.
Figure 12:
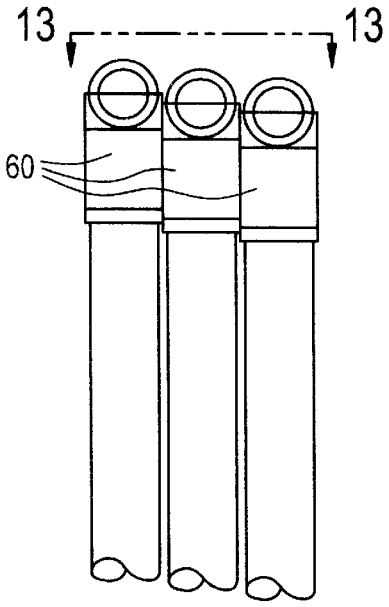
FIG. 12 is a left side view of the slag tap "K" forging arrangement of FIG. 11, viewed in the direction of arrows 12—12, illustrating how multiple, staggered slag tap "K" forgings and their associated furnace floor tubes are assembled next to one another to produce the double pitch sloping furnace floor.
Figure 11:
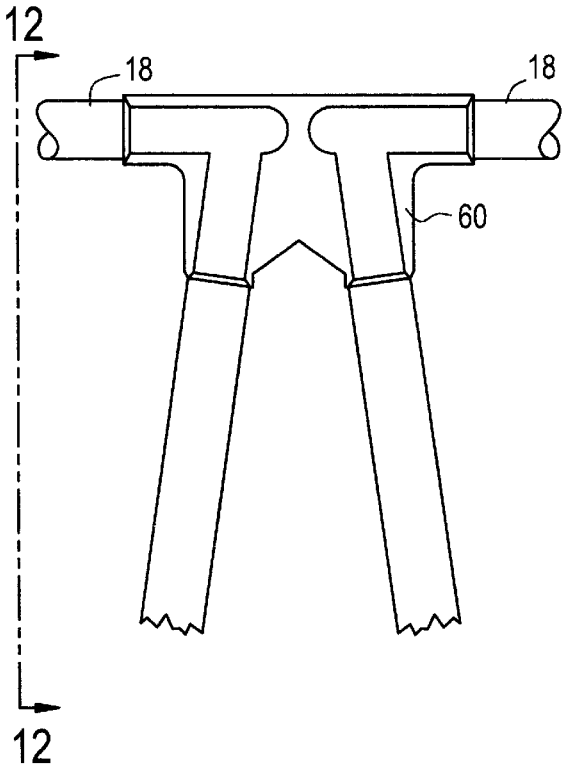
FIG. 11 is a close up view illustrating a single slag tap "K" forging of the type illustrated in FIG. 10.
Figure 13:
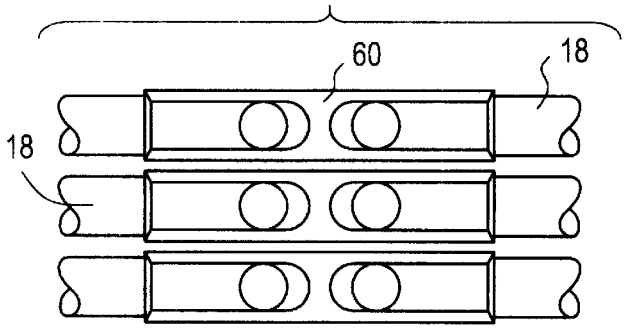
FIG. 13 is a top plan view of FIG. 12, viewed in the direction of arrows 13—13.

The steam generator coal gasifier 10 also includes a steam drum 54. Conduits (not shown) lead from the drum 54 to lower manifolds 56 (see FIG. 10) of the membrane tube panels of the steam generator coal gasifier 10 enclosure 14 walls, with other conduits leading from upper manifolds of the enclosure 14 thereof, and back into the drum 54.

An inlet to the EC 34 is connected to a boiler feed water supply conduit (not shown) with an outlet thereof being connected to a conduit leading to the steam drum 54. The steam drum 54 is also provided with a level control arrangement known in the art. As is also known in the boiler art, a steam conduit leads from the top of the steam drum 54 to an inlet of the PSH 32, while a conduit leading from an outlet of the PSH 32 leads to an inlet of the SSH 30. The conduit is provided with a spray water steam attemperator (not shown) with a boiler feed water conduit leading from the boiler feed water conduit to the spray water steam attemperator, or other means of temperature control i.e. condenser. A superheated steam conduit leads from the outlet SSH to the plant boundary. Approximately 60 bar superheated steam can thus be withdrawn from the conduit. Temperature control means may be provided between the conduit and the boiler feed water supplied to the spray water steam attemperator.

Suitable coal feed means (not shown) and pulverizers (also not shown) supply pulverized coal to the burners 42 in the burner zone 16. Carbon dioxide constitutes the pneumatic conveying medium for conveying the pulverized coal pneumatically from a supply to the burners. An oxygen supply line also is provided to each of the burners 42. The steam generator coal gasifier 10 further includes nitrogen supply fitted with a blower for purging the system with nitrogen on startup/shutdown.

In operation, pulverized coal is fed to each burner 42 at a controlled rate pneumatically using carbon dioxide as conveying medium. A control arrangement (not shown) controls the carbon dioxide flow rate at a fixed value. Pulverized coal is delivered to the burners 42 via flow control gates and a flow rate measuring device or arrangement. The pulverized coal is delivered into a stream of the carrier gas, for example, (carbon dioxide) which in turn carries the coal to the burners 42. Simultaneously, oxygen is fed along flow lines through the burners 42. The burners 42 are preferably of a so-called diffusion type, with combustion of the oxygen and pulverized coal taking place inside the steam generator coal gasifier 10's enclosure 14. Slag, typically at a temperature of about 1400° C., is quenched and extracted by means of the double pitch sloping furnace floor 18, slag tap 20, slag neck 22, and slag tank 36 or drag chain conveyor 38.

The pulverized coal and oxygen react, on burning within the enclosure 14, to produce a gaseous component comprising carbon monoxide and hydrogen, as well as ash. More particularly, a sub-stoichiometric proportion of oxygen is employed. The coal first burns with oxygen to generate carbon dioxide and water at a high temperature. These gases then react with the remaining coal to yield carbon monoxide and hydrogen. The gaseous component (i.e., synthetic gas 12) exits from the enclosure 14 via outlet 40 as a gaseous product (temperature typically about 200° C.) and passes through cyclone ash removal device 58.

Referring now to FIGS. 10–13, another feature of the present invention which has not heretofore been employed in known gasifier designs, involves the double pitch sloping furnace floor 18, and which preferably comprises a plurality of K-forgings 60 which physically interconnect tubes forming the sloping furnace floor 18 and fluidically interconnect them with headers or manifolds 56 located beneath the sloping furnace floor 18. Generally, each K-forging 60 physically joins two tubes from opposite front and rear walls of the enclosure 14 to form the double pitch sloping furnace floor 18. Each K forging 60 has flat sides which facilitates staggering multiple slag tap "K" forgings and welding them together so that their associated furnace floor tubes are assembled next to one another to produce the double pitch sloping furnace floor 18. These particular type of K forgings were adapted from a different type of environment, namely, a cyclone furnace environment. For typical cyclone boilers, B&W recommends a 24" by 36" floor tap opening, larger than the original floor tap size of 18" by 24". The floor tap size was increased in order to accommodate Western, high ash coals, and/or coals with a high ash fusion temperature. Although Western coals usually have a low ash percentage, the low combustion radiant heat and ash characteristics combine to produce a slag which can get very sluggish. This can lead to bridging and closure of the floor slag tap. The double pitch sloping furnace floor 18 with K forgings 60 is actually a design used for supercritical pressure cyclone boiler floor units, not for a B&W El Paso™ type drum boiler construction.

The heat combustion generated in the enclosure 14 is used to heat directly, i.e., without any quenching thereof with water, the boiler feed water passing along the boiler feed water tubes of the enclosure 14 walls to generate approximately 60 bar steam, to heat incoming boiler feed water in the EC 34, and to superheat the steam from the drum 54 in the PSH 32 and SSH 30.

The flow arrangement sets the oxygen flow rate to meet a required flow rate of useful gas as measured by measuring devices known in this art and designed as the carbon monoxide and hydrogen in the gas product. The control arrangement also adjusts the coal to oxygen ratio to maintain a required concentration of carbon dioxide in the gas produced.

In the steam generator coal gasifier 10 all waste heat is recovered as high pressure superheated steam, and an external water quench is not required. Scrubbing of the synthesis gas 12 after it exits from the cyclone separator 58 can be included if desired. The pressure drop through the steam generator coal gasifier 10 is such that the synthesis gas 12 is delivered at a required pressure without the need for a booster blower.

The steam generator coal gasifier 10 can be used in the manufacture of any chemicals requiring either carbon monoxide and/or hydrogen or both as raw materials. Such chemicals include ammonia and its derivatives, methanol and its derivatives, acetic acid and its derivatives, etc. The steam generator coal gasifier 10 can also form at least part of an integrated electricity generation plant.

It is believed that, in the steam generator coal gasifier 10, more than 85% of the theoretical waste heat generated may be recovered as high pressure superheated steam suitable for driving a steam turbine, where the theoretical waste heat is defined as the heating value of the coal inputted into the steam generator coal gasifier 10 less the heating value of the gas, fly ash and slag exiting the gasifier.

It is also believed that a higher proportion of coal will be converted in the steam generator coal gasifier 10 than is converted in known gasifiers, thereby reducing the quantities of fly ash produced. Additionally, in the steam generator coal gasifier 10, consumption of electricity will be substantially reduced, the consumption of water to quench the raw gas will be eliminated and the safety of the process will be improved, as compared to known processes using quenching of the product gases in the steam generator coal gasifier 10.

Furthermore, gas produced in the steam generator coal gasifier 10 which may contain highly corrosive components is kept within a fully water cooled enclosure 14 until the temperature of the synthesis gas 12 is below that at which corrosion rates become significant. The temperature of the enclosure 14 itself is maintained at the boiling point of the water within the walls of the steam generator coal gasifier 10 by selecting an appropriate operating pressure. To achieve this it is possible to select materials for the construction of the steam generator coal gasifier 10 walls which are in common use in the construction of modem pressurized industrial boilers.

While a specific embodiment of the invention has been shown and described in detail to illustrate the application of the principles of the invention, it will be understood that the invention may be embodied otherwise without departing from such principles.

We claim:

1. An integral steam generator coal gasifier for simultaneously producing synthesis gas from coal, and steam from heat produced by a coal gasification process, comprising:

a vertically elongated, all welded, gas tight enclosure having walls made from a plurality of membrane wall tube panels, the coal gasification process occurring within the enclosure and producing hot synthesis gas; heat which is transferred into a mixture of water and steam flowing through the tube panels, the enclosure for conveying the hot synthesis gas from a burner zone at a lower portion thereof to an outlet;

a burner zone having at least one elevation of offset burners in the burner zone, at least one burner provided and arranged so as to fire through each wall of the enclosure;

a double pitch sloping furnace floor at a bottom of the burner zone and having a slag tap extending therethrough;

a corrosion resistant zone above the burner zone;

an upper cooling zone above the corrosion resistant zone;

a multi-pass convection pass zone above the upper cooling zone, the convection pass zone formed by some tubes of a rear wall, said walls being made from a plurality of membrane wall tube panels, being bent inwardly out of the plane of said rear wall to form a dividing wall forming an upflow and a downflow pass within a footprint occupied by the enclosure for conveying the synthesis gas from the upper cooling zone to the outlet by way of said upflow pass and downflow pass and defining a region containing heating surfaces which extract heat from the synthesis gas as it flows across the heating surfaces;

ash removal means connected to an outlet of the convection pass zone for separating ash from the synthesis gas exiting from the convection pass zone; and slag removal means communicating with the slag tap for receiving slag from the burner zone.

2. The steam generator coal gasifier according to claim 1, further comprising a slag neck connected to the slag tap.

3. The steam generator coal gasifier according to claim 2, wherein the slag removal means comprises one of a slag tank and a drag chain conveyor communicating with the slag neck.

4. The steam generator coal gasifier according to claim 1, wherein the double pitch sloping furnace floor and walls of the burner zone comprise a pattern of pin studs covered by a refractory material.

5. The steam generator coal gasifier according to claim 1, wherein the ash removal means comprises a cyclone separator device connected to the outlet of the convection pass zone.

6. The steam generator coal gasifier according to claim 1, wherein the enclosure walls of the corrosion resistant zone comprise bimetallic membrane tube panels.

7. The steam generator coal gasifier according to claim 1, wherein the enclosure walls of the upper cooling zone comprise carbon steel membrane tube panels.

8. The steam generator coal gasifier according to claim 1, wherein the heating surfaces within the convection pass zone comprise superheater and economizer surfaces for extracting heat from the synthesis gas.

9. The steam generator coal gasifier according to claim 8, wherein the superheater surfaces comprise secondary and primary superheater surface in the upflow pass and economizer surface in the downflow pass.

10. The steam generator coal gasifier according to claim 1, wherein the double pitch sloping furnace floor and the walls of the burner zone are comprised of ribbed tubes having a pattern of pin studs thereon covered by a refractory material.

11. The steam generator coal gasifier according to claim 1, wherein each of the offset burners are arranged to fire through their associated wall of the enclosure at an angle $\theta$ with respect to a line perpendicular to the associated wall, angle $\theta$ lying within a range of about 0 degrees to about 25 degrees.

12. The steam generator coal gasifier according to claim 11, wherein angle $\theta$ lies within a range of about 15 degrees to about 25 degrees.

13. The steam generator coal gasifier according to claim 1, comprising at least one elevation of offset burners in the burner zone, at least one burner being provided and arranged so as to fire through each wall of the enclosure, each one burner being located on its associated wall a distance away from a corner of the enclosure lying within a range of about one-fifth to about one-third of the width of the associated wall.

14. The steam generator coal gasifier according to claim 1, wherein the double pitch sloping furnace floor comprises a plurality of K-forgings which fluidically interconnect tubes forming the sloping furnace floor with collecting headers located beneath the sloping furnace floor.

15. The steam generator coal gasifier according to claim 14, wherein each K-forging physically interconnects two tubes forming the sloping furnace floor.

16. An integral steam generator coal gasifier for simultaneously producing synthesis gas from coal, and steam from heat produced by a coal gasification process, comprising:

a vertically elongated, all welded, gas tight enclosure having walls made from a plurality of membrane wall tube panels, the coal gasification process occurring within the enclosure and producing hot synthesis gas; heat which is transferred into a mixture of water and steam flowing through the tube panels, the enclosure for conveying the hot synthesis gas from a burner zone at a lower portion thereof to an outlet;

a burner zone having at least one elevation of offset burners in the burner zone, at least one burner provided and arranged so as to fire through each wall of the enclosure;

a double pitch sloping furnace floor at a bottom of the burner zone and having a slag tap extending therethrough;

a corrosion resistant zone above the burner zone;

an upper cooling zone above the corrosion resistant zone;

a multi-pass convection pass zone above the upper cooling zone, the convection pass zone defining a region containing heating surfaces which extract heat from the synthesis gas as it flows across the heating surfaces;

ash removal means connected to an outlet of the convection pass zone for separating ash from the synthesis gas exiting from the convection pass zone; and slag removal means communicating with the slag tap for receiving slag from the burner zone.

17. The steam generator coal gasifier according to claim 16, wherein each of the offset burners are arranged to fire through their associated wall of the enclosure at an angle θ, in a horizontal plane with respect to a line perpendicular to the associated wall and included in the horizontal plane, angle θ lying within a range of about 0 degrees to about 25 degrees.

18. The steam generator coal gasifier according to claim 17, wherein angle θ lies within a range of about 15 degrees to about 25 degrees.

19. An integral steam generator coal gasifier for simultaneously producing synthesis gas from coal, and steam from heat produced by a coal gasification process, comprising:

a vertically elongated, all welded, gas tight enclosure having walls made from a plurality of membrane wall tube panels, the coal gasification process occurring within the enclosure and producing hot synthesis gas; heat which is transferred into a mixture of water and steam flowing through the tube panels, the enclosure for conveying the hot synthesis gas from a burner zone at a lower portion thereof to an outlet;

a burner zone having at least one elevation of offset burners in the burner zone, at least one burner being provided and arranged so as to fire through each wall of the enclosure, each one burner being located on its associated wall a distance away from a corner of the enclosure lying within a range of about one-fifth to about one-third of the width of the associated wall;

a double pitch sloping furnace floor at a bottom of the burner zone and having a slag tap extending therethrough;

a corrosion resistant zone above the burner zone;

an upper cooling zone above the corrosion resistant zone;

a multi-pass convection pass zone above the upper cooling zone, the convection pass zone defining a region containing heating surfaces which extract heat from the synthesis gas as it flows across the heating surfaces;

ash removal means connected to an outlet of the convection pass zone for separating ash from the synthesis gas exiting from the convection pass zone; and slag removal means communicating with the slag tap for receiving slag from the burner zone.

20. An integral steam generator coal gasifier for simultaneously producing synthesis gas from coal, and steam from heat produced by a coal gasification process, comprising:

a vertically elongated, all welded, gas tight enclosure having walls made from a plurality of membrane wall tube panels, the coal gasification process occurring within the enclosure and producing hot synthesis gas; heat which is transferred into a mixture of water and steam flowing through the tube panels, the enclosure for conveying the hot synthesis gas from a burner zone at a lower portion thereof to an outlet;

a burner zone constructed and designed to resist the corrosion and erosion environment created by the gas process;

a double pitch sloping furnace floor at a bottom of the burner zone and having a slag tap extending therethrough, the floor including a plurality of K-forgings which fluidically interconnect tubes forming the sloping furnace floor with collecting headers located beneath the sloping furnace floor;

a corrosion resistant zone above the burner zone;

an upper cooling zone above the corrosion resistant zone;

a multi-pass convection pass zone above the upper cooling zone, the convection pass zone defining a region containing heating surfaces which extract heat from the synthesis gas as it flows across the heating surfaces;

ash removal means connected to an outlet of the convection pass zone for separating ash from the synthesis gas exiting from the convection pass zone; and slag removal means communicating with the slag tap for receiving slag from the burner zone.

21. The steam generator coal gasifier according to claim 20, wherein each K-forging physically interconnects two tubes forming the sloping furnace floor.

* * * * *